US006698520B2

(12) United States Patent
Fenton et al.

(10) Patent No.: US 6,698,520 B2
(45) **Date of Patent: *Mar. 2, 2004**

(54) LIGHT-INTERVENTION SUBSEA TREE SYSTEM

(75) Inventors: Stephen P. Fenton, Inverurie (GB); John H. Osborne, Nesbru (NO); Rolf Nordaunet, Tranby (NO)

(73) Assignee: ABB Vetco Gray Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/262,588

(22) Filed: Sep. 30, 2002

(65) Prior Publication Data

US 2003/0042025 A1 Mar. 6, 2003

Related U.S. Application Data

(63) Continuation of application No. 09/732,817, filed on Dec. 8, 2000, now Pat. No. 6,460,621.
(60) Provisional application No. 60/170,061, filed on Dec. 10, 1999.

(51) Int. Cl.[7] ..... E21B 33/038
(52) U.S. Cl. ..... 166/347; 166/368
(58) Field of Search ..... 166/347, 368, 166/339, 341, 344, 350

(56) References Cited

U.S. PATENT DOCUMENTS

| | | | | |
|---|---|---|---|---|
| 3,358,753 A | | 12/1967 | Haeber | 166/6 |
| 4,848,475 A | | 7/1989 | Dean et al. | 166/339 |
| 4,899,822 A | | 2/1990 | Daeschler et al. | 166/339 |
| 5,299,641 A | | 4/1994 | Paulo et al. | 166/341 |
| 5,992,527 A | | 11/1999 | Garnham et al. | 166/379 |
| 6,053,252 A | | 4/2000 | Edwards | 166/348 |
| 6,460,621 B2 | * | 10/2002 | Fenton et al. | 166/347 |
| 6,547,008 B1 | * | 4/2003 | Hopper et al. | 166/348 |

FOREIGN PATENT DOCUMENTS

| | | |
|---|---|---|
| WO | WO00/70185 | 11/2000 |

* cited by examiner

*Primary Examiner*—Zakiya Walker
(74) *Attorney, Agent, or Firm*—Bracewell & Patterson, L.L.P.

(57) ABSTRACT

A subsea well apparatus has features for controlling and monitoring production fluid flow from a well. A christmas tree lands on a subsea wellhead, the tree having a tubular, open upper end. A first flow passage extends from a lower end of the tree to the upper end for communicating fluid with the well. A second flow passage extends downward from the upper end of the tree and has an outlet on a sidewall of the tree for communicating with a flowline. A production module lands on and is retrievable from the upper end of the tree, the module having a flow loop with one end in communication with the first flow passage and another end in communication with the second flow passage. At least one flow interface device is located in the loop of the production module. The flow interface device may be used to monitor or control the flow and may be a temperature or pressure sensor, a flow or multi-phase flow meter, or a choke.

13 Claims, 2 Drawing Sheets

LIGHT-INTERVENTION SUBSEA TREE SYSTEM

CROSS-REFERENCE TO RELATED APPLICATIONS

Benefit is herein claimed of the filing date under 35 USC §119 and/or §120 and CFR 1.78 to U.S. Provisional Patent Application Serial No. 60/170,061, filed on Dec. 10, 1999, entitled "Light Intervention Subsea Tree System." This application is a continuation of application Ser. No. 08/732,817, filed Dec. 8, 2000, now U.S. Pat. No. 6,460,621.

BACKGROUND OF THE INVENTION

1. Field of the Invention

This invention relates in general to subsea oil and gas production systems and in particular to a subsea tree assembly having certain components that are retrievable by a light-duty workover vessel.

2. Description of the Prior Art

A conventional subsea wellhead assembly includes a wellhead housing which supports one or more casing hangers located at upper ends of strings of casing extending into the well. A production tree is landed on the wellhead for controlling the production of well fluids. The tree usually carries a choke and valves to control the flow and sensors to monitor the flow.

With both conventional and horizontal trees, external chokes and production valves are used to control the flow. If the valves or choke are in need of service, retrieval is difficult and may require the use of a remotely-operated vehicle. Various valves and controls have been located on an apparatus separately retrievable from the tree, but many of the components requiring service may require that the entire tree be removed.

SUMMARY OF THE INVENTION

A subsea well apparatus is provided for controlling and monitoring production fluid flow from a well. A christmas tree is adapted to land on a subsea wellhead, the tree having a tubular, open upper end. A first flow passage extends from a lower end of the tree to the upper end for communicating fluid with the well. A second flow passage extends downward from the upper end of the tree and has an outlet on a sidewall of the tree for communicating with a flowline. The second flow passage is connected to an annulus access passage and is separated from the annulus access passage by a valve. A production module lands on and is retrievable from the upper end of the tree, the module having a flow loop with one end in communication with the first flow passage and another end in communication with the second flow passage. At least one flow interface device is located in the loop of the production module. The flow interface device may be used to monitor or control the flow and may be a temperature or pressure sensor, a flow or multi-phase flow meter, or a choke.

BRIEF DESCRIPTION OF THE DRAWINGS

The novel features believed to be characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
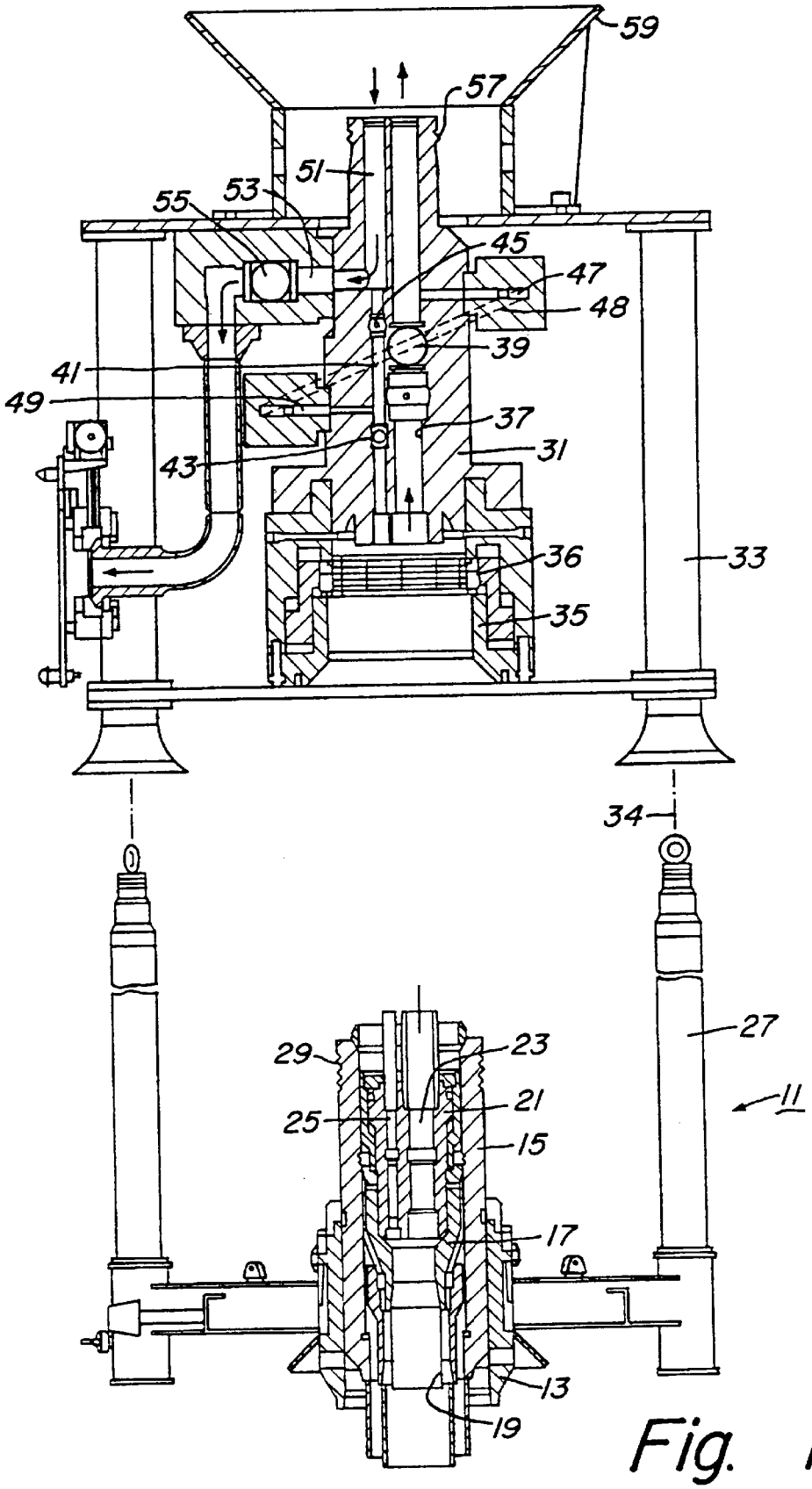
FIG. 1 is a sectional view illustrating a subsea tree constructed in accordance with this invention shown being landed on a subsea wellhead assembly.

Referring to FIG. 1, subsea wellhead assembly 11 is conventional. It includes an outer low-pressure wellhead housing 13 that is located at the upper end of a string of a large diameter conductor that extends into the well to a first depth. An inner high-pressure wellhead housing 15 locates within outer wellhead housing 13 and protrudes above. Inner wellhead housing 15 is a tubular member secured to the upper end of large diameter casing that extends to a second depth in the well. The well will have typically two casing hangers 17. The lower one is secured to a string of casing that extends to a third depth in the well. The uppermost casing hanger 17 is secured to production casing 19 that extends to the total depth of the well. Subsea wellhead 11 has four guide posts 27 extending upward. The upper end of inner wellhead housing 15 is a tubular mandrel 29 having an exterior profile with grooves.

A conventional tubing hanger 21 lands in the bore of inner wellhead housing 15 above the uppermost casing hanger 17. Tubing hanger 21 is secured to a string of tubing (not shown) extending into the well. Tubing hanger 21 has an axially extending production passage 23. An annulus passage 25 extends through tubing hanger 21 parallel to and offset from production passage 23. Production passage 23 communicates with the interior of the string of tubing, while annulus passage 25 communicates with an annulus between the string of tubing and production casing 19.

A production tree 31 is adapted to land on subsea wellhead 11 for controlling fluids produced from the well. Tree 31 may alternately be an injection tree for controlling fluids injected into the well. Production tree 31 has guide receptacles 33 that are received over guide posts 27 as tree assembly 31 is being lowered on guidelines 34. Tree 31 has a wellhead connector 35 on its lower end. Connector 35 is conventional, having dogs 36 that are hydraulically actuated for engaging the grooves on mandrel 29 or having a similar connection device using, for example, collets.

An axial first or upward-flow production passage 37 extends through tree 31. One or more master valves 39, preferably gate valves, selectively open and close upward-flow production passage 37. An annulus access passage 41 extends upward to the upper end of tree 31 parallel to and offset from upward-flow production passage 37. Annulus access passage 41 communicates with annulus passage 25 of tubing hanger 21, while production passage 37 communicates with production passage 23 of tubing hanger 21. Annulus access passage 41 has two annulus valves 43, 45. An external cross-over line 48 extends from a port 47 in upward-flow production passage 37 to a port 49 in annulus access passage 41 between annulus valves 43, 45 to communicate annulus 25 with upward-flow production passage 37. A valve (not shown) will also be contained in the cross-over line 48. Cross-over line 48 enables fluid to be pumped down annulus access passage 41, through cross-over line 48, and down production passage 37 to kill the well, if desired.

Tree 31 also has a second or downward-flow production passage 51 that extends upward from annulus access passage 41 above annulus valve 45. Downward-flow production passage 51 is coaxial with annulus access passage 41 and intersects annulus access passage 41 above annulus valve 45. Downward-flow passage 51 can communicate with the lower portion of annulus access passage 41 by opening annulus valves 43, 45. Downward-flow passage 51 is parallel to and offset from upward-flow production passage 37 and leads to a lateral production passage 53 for controlling flow into an attached flowline. A production valve 55 is located in lateral production passage 53.

The upper end of tree 31 is formed into a configuration of a mandrel 57, having grooves on the exterior. Tree mandrel 57 has a smaller outer diameter than wellhead housing mandrel 29 in this embodiment. An upward facing funnel 59 surrounds tree mandrel 57 for guidance.

Figure 2:
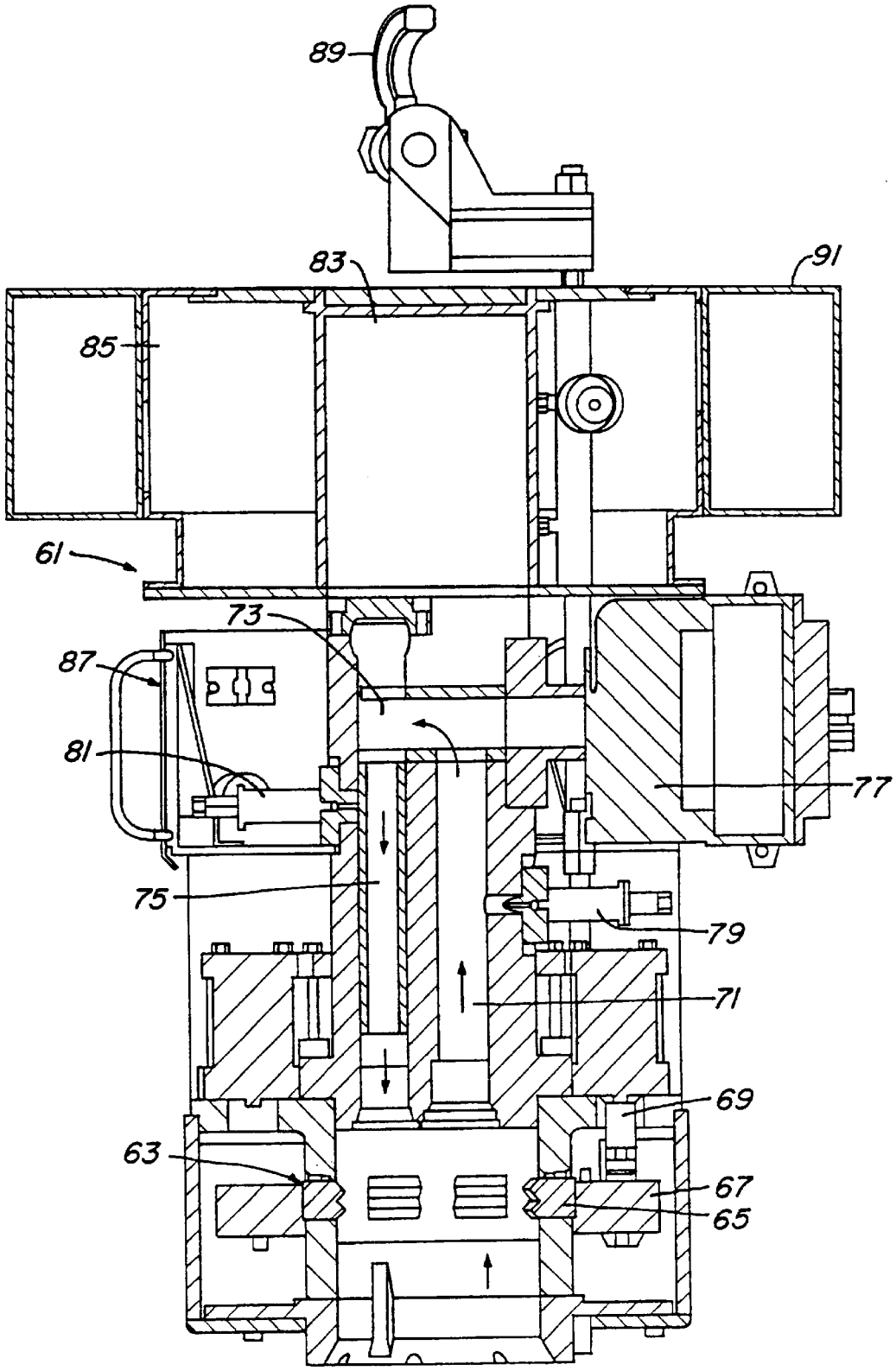
FIG. 2 is an enlarged sectional view of a production module that lands on the subsea tree of FIG. 1.

A production module 61 is shown in FIG. 2. Production module 61 is adapted to land on tree mandrel 57. Production module 61 has a tree connector 63 on its lower end that is of a conventional design. Tree connector 63 has a plurality of dogs 65 that are moved radially inward into engagement with the profile on tree mandrel 57 (FIG. 1) by means of a cam ring 67 or has a similar connection device using, for example, collets. Hydraulic cylinders 69 move cam ring 67 upward and downward. Production module 61 has an upward-flow passage 71 that is positioned to register with upward-flow production passage 37 (FIG. 1). Module upward-flow passage 71 leads upward to a cross-over passage 73. Cross-over passage 73 leads to a downward-flow passage 75 that is parallel to and offset from upward-flow passage 71. Downward-flow passage 75 is oriented to align and communicate with downward-flow production passage 51 in tree 31 (FIG. 1). The set of internal flow passages comprising passages 71, 73, and 75 forms a flow loop within module 61. If an injection tree is used instead of a production tree, the flow directions in passages 71, 73, 75 of module 61 will be reversed.

One or more Flow interface devices can lie within or adjacent to and in communication with the flow loop of module 61. The devices may be a variety of types for controlling or measuring, such as a choke, a pressure or temperature sensor, or a flow meter. Shown in FIG. 2 is a choke assembly 77 located in cross-over passage 73. Choke assembly 77 is of a conventional design and used for variably restricting the flow of production fluid flowing through cross-over passage 73. An upstream pressure and temperature sensor 79 locates on the upstream side of choke 77. A downstream pressure and temperature sensor 81 locates on the downstream side of choke assembly 77. Also, preferably, a multi-phase flow meter is utilized for measuring the flow rate through cross-over passage 73. Flow meter controls 83, shown schematically, are located at the upper end of production module 61 for serving the flow-metering hardware located in passage 73.

Hydraulic and electric controls 85 for production module 61 and tree 31 are also located adjacent to flow meter controls 83. These controls 85 serve the various valves, such as master valve 39, annulus valves 43, 45, and production valve 55. An ROV panel 87 may be located on one side of production module 61 for allowing engagement by remote operated vehicles for performing various operations. Production module 61 has a lift wire attachment 89 on its upper end to enable it to be retrieved and re-installed by a light duty workover vessel (not shown) at the surface. Production module 61 may have an annular buoyant tank 91 located near an upper portion of module 61. Tank 91 may be filled with air or a buoyant material to assist in retrieving module 61.

In operation, the subsea well will be completed conventionally with a subsea wellhead assembly 11 as shown in FIG. 1. Tree 31 will be lowered on guide wires 34 into engagement with mandrel 29 of wellhead housing 15. Then, production module 61 is lowered on a lift wire into engagement with mandrel 57 of tree 31 (FIG. 1) with the assistance of upward facing funnel 59 or guideposts.

During production, well fluid will flow as indicated by the arrows up tubing hanger production passage 23 and tree production passage 37. The well fluid flows upward into upward-flow passage 71 of production module 61, shown in FIG. 2. As indicated by the arrows, well fluid flows through cross-over passage 73 and then through downward-flow passage 75. Choke 77 will control the rate of flow. Sensors 79, 81 will monitor pressure and temperature. Flow meter controls 83, if utilized, will monitor the flow rate and water cut. The flow proceeds through downward-flow passage 75 back into tree 31 via downward-flow passage 51 (FIG. 1). The production flow proceeds out lateral passage 53 to a flow line.

The moveable components on tree 31, such as valves 39, 43, 45 and 55 typically require little maintenance. Intervention to change the valves or any other components of tree 31 is not expected to be frequently required. The components of production module 61 are more active and more subject to failure. These components include choke 77, flow meter controls 83 and the pressure and temperature sensors 79, 81. Production module 61 can be readily retrieved by a small vessel using a lift line to repair or replace any of these components or to allow communication with annulus access passage 41 at the top of the tree 31. The small vessel need not be large enough to run casing, tubing or to retrieve a tree.

While the invention is shown in only one of its forms, it should be apparent to those skilled in the art that it is not so limited, but is susceptible to various changes without departing from the scope of the invention.

What is claimed is:

1. A subsea well apparatus comprising:

a christmas tree adapted to land on a subsea wellhead located at a well, the tree having a tubular, open upper end;

a flow passage extending from a lower end of the tree to the upper end for communicating fluid with the well;

a port on a sidewall of the tree for communicating with a flowline;

a production module that lands on and is retrievable from the upper end of the tree, the module having a flow loop with one end in communication with the flow passage and another end in communication with the port; and at least one flow interface device in the loop of the production module.

2. The apparatus of claim 1, wherein the flow interface device comprises at least one of the following:

a pressure sensor;

a temperature sensor;

a flow-rate sensor; end a choke.

3. The apparatus of claim 1, wherein:

the production module contains hydraulic controls for controlling valves in the tree.

4. The apparatus of claim 1, wherein:

the flow passage handles production flow flowing upward from the well and the loop discharges the production fluid into the flowline.

5. The apparatus of claim 1, further comprising:

an annulus passage extending from the lower end of the tree to the upper end the annulus passage being offset from the flow passage.

6. The apparatus of claim 1, wherein said another end communicates with the port via an internal passage in the tree.

7. The apparatus of claim 1, wherein:

a valve is located in the flow passage between the lower and upper ends of the tree.

8. An apparatus for a production tree landed on a subsea wellhead, the tree having a tubular, open upper end and a flow passage extending from a lower end of the tree to the upper end for communicating fluid with the well, the tree having a port on a sidewall of the tree for communicating with a flowline, the apparatus comprising:

a production module adapted to land on and be retrieved from the upper end of the tree, the module having a flow passage that defines a flow loop, one end of the flow loop adapted to be in communication with the flow passage and another end of the flow loop adapted to be in communication with the port;

at least one flow interface device in the loop of the production module; and wherein the flow interface device comprises at least one of the following:

a preassure sensor;

a temperature sensor;

a flow-rate sensor; and a choke.

9. The apparatus of claim 8, wherein:

the production module contains hydraulic controls for controlling valves in the tree.

10. A method of producing production fluids from a subsea well, the method comprising:

landing a christmas tree on a subsea wellhead located at a well, the tree having a tubular, open upper end;

providing a flow passage through the tree extending from a lower end of the tree to the upper end for communicating fluid with the well;

providing a port on a sidewall of the tree that communicates with a flowline;

landing a production module on the upper end of the tree, the module having a flow loop with one end in communication with the flow passage and another end in communication with the port;

flowing fluids through the flow passage, the flow loop of the module, the port and the flowline; and providing at least one flow interface device in communication with the flow loop of the production module and interacting the flow interface device with the fluid.

11. The method of claim 10, wherein interacting the flow interface device with the fluid comprises measuring characteristics of the flow using the interface device, the measured characteristics including at least one of the following: pressure, temperature, and flow rate.

12. The method of claim 10, wherein interacting the flow interface device with the fluid comprises controlling the flow through the loop of the production modulee with a choke.

13. The method of claim 10, wherein the step of flowing fluids through the flow loop comprises flowing well fluid from the well upward through the flow passage, flow loop, and out the port to the flowline.

* * * * *